United States Patent [19]

Chiu

[11] Patent Number: 5,031,899

[45] Date of Patent: Jul. 16, 1991

[54] HEIGHT ADJUSTMENT APPARATUS FOR INFANT WALK SUPPORT

[75] Inventor: Hsui-Hui Chiu, Tainan Hsien, Taiwan

[73] Assignee: Sunshon Molding Co., Ltd., Tainan Hsien, Taiwan

[21] Appl. No.: 450,176

[22] Filed: Dec. 13, 1989

[51] Int. Cl.[5] ..... A61H 3/00

[52] U.S. Cl. ..... 272/70.3; 297/6

[58] Field of Search ..... 272/70.3, 70.4, DIG. 4; 280/87.051, 649; 297/5, 6, 56; 108/118, 119

[56] References Cited

U.S. PATENT DOCUMENTS 4,359,242 11/1982 Gerken et al. ..... 297/5

4,433,869 2/1984 Payne Jr. et al. ..... 108/119

4,759,541 7/1988 Chen ..... 272/70.3

4,799,700 1/1989 Knoedler et al. ..... 297/6

*Primary Examiner*—Stephen R. Crow

*Attorney, Agent, or Firm*—Morton J. Rosenberg; David I. Klein

[57] ABSTRACT

A height adjustment for infant walk support comprises a base mounted on casters, a table top having an opening surrounded with a perimeter and a pair of crossed bars each of which is pivoted at the middle. The crossed bars have respective ends articulated to respective ends of the base and the table top. The other respective ends of the crossed bars connected pivotally to the table top and the base through slider members including a bracket member in connection to the base an an adjustment control device in connection to the table top.

3 Claims, 5 Drawing Sheets

HEIGHT ADJUSTMENT APPARATUS FOR INFANT WALK SUPPORT

This invention relates in general to a height adjustment apparatus for a child walk support.

The leg adjustment apparatus for raising or lowering the table support rim height incorporates telescoping tubular leg sections in vertically extending legs. The telescoping leg sections include a spring biased pin on one leg section, which engages in any one of a plurality of spaced holes in the other or mating section. As may be appreciated this arrangement is extremely difficult to adjust since each pin must be individual disengaged from one hole and readjusted or aligned with another hole when height changes are desired, and each leg must therefore be individually adjusted.

SUMMARY OF THE INVENTION

An object of this invention is to provide a height adjustment apparatus for an infant walk support which can diminish the disadvantages of a known infant walk support.

It is another object of this invention to provide a height adjustment apparatus for infant walk support which can be smoothly operated in height adjustment and securely and reliably lock in position according to infant's height.

BRIEF DESRIPTION OF THE DRAWINGS

DETAILED DESCRIPTION OF THE PREFERRED EMBODIMENT

Figure 1:
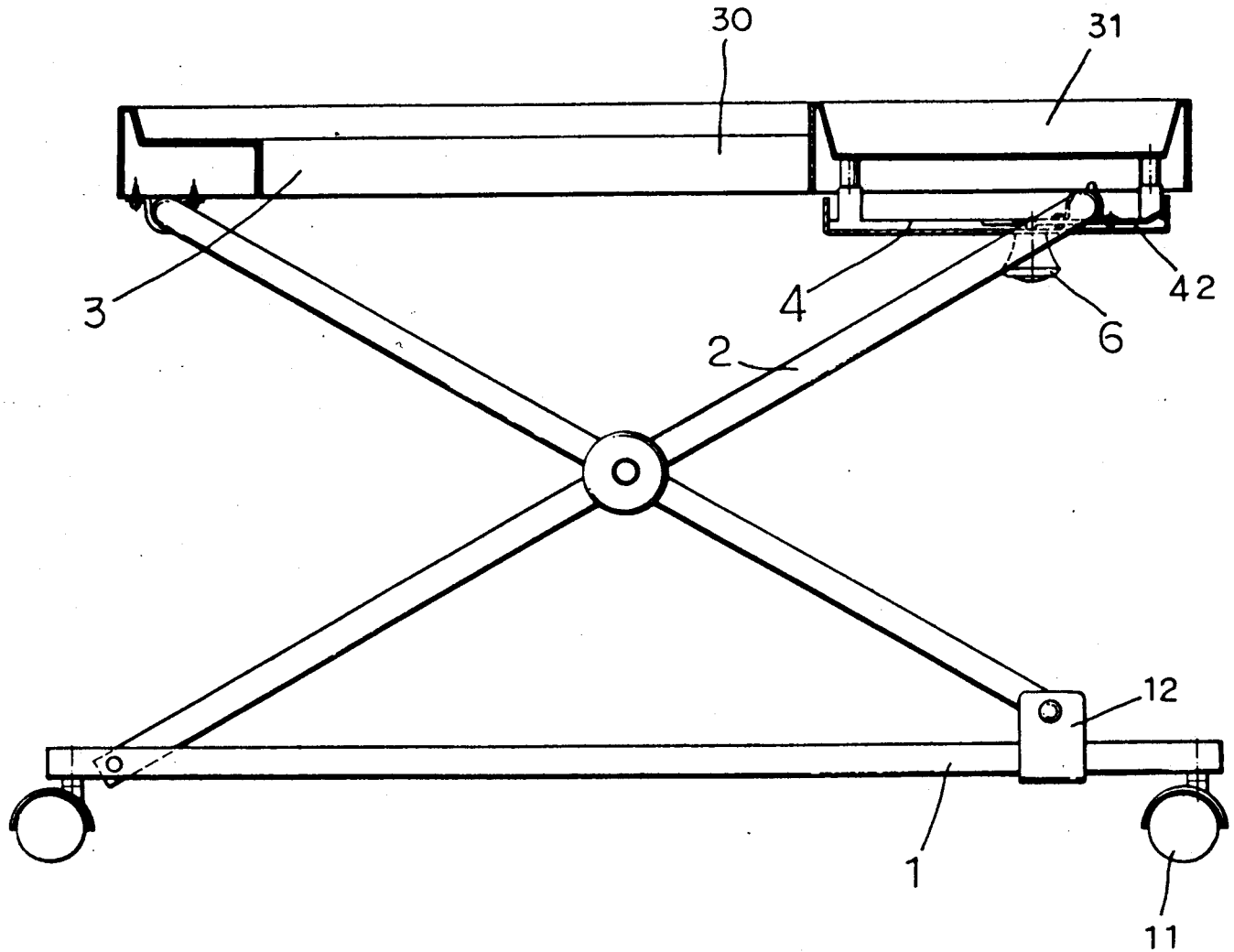
FIG. 1 is a side elevational and partially cross-sectional view of an infant walk support using the height adjustment apparatus according to this invention.

Referring now to FIG. 1, an infant walk support includes a table top 3, a base 1 mounted on casters 11 by which the base 1 may be moved from one point to another, and a pair of crossed bars 2 pivoted at the middles and interconnected by crossbeams 20 at upper ends (not shown in FIG. 1) for coupling the table top 3 and the base 1.

The front ends of the crossed bars 2 are respectively connected pivotally to the table 3 and the base 1 through slider members wherein the slider members connected to the base 1 are conventional bracket members 12 and the slider member connected to the bottom of the table top 3 is an adjustment control device 4.

The table top 3 has an opening 30 for confining an infant taking his or her walks in practice and a front portion 31 for accommodating, such as, toys.

Figure 2:
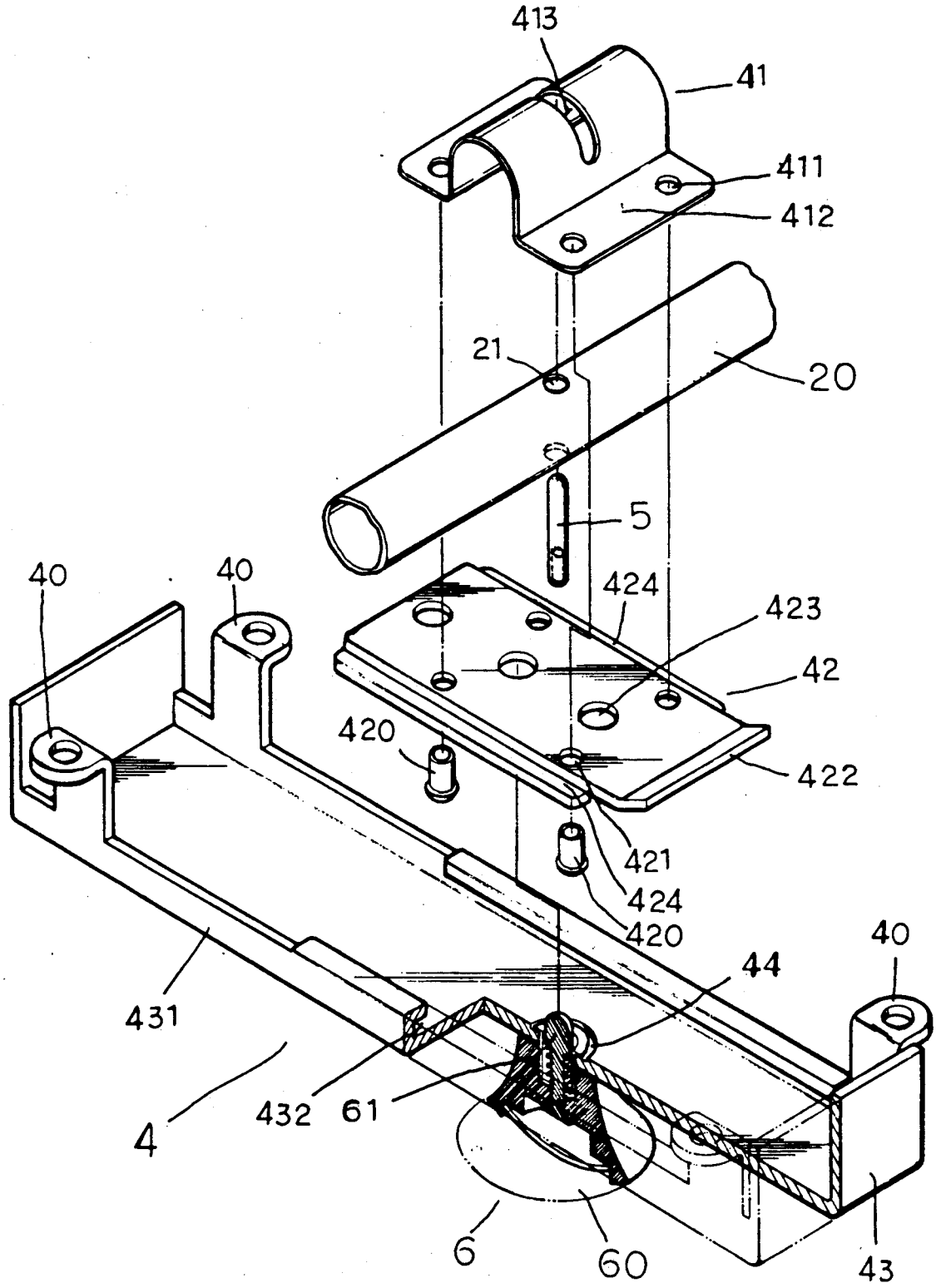
FIG. 2 is and enlarged and exploded perspective view of the height adjustment of this invention.
Figure 3:
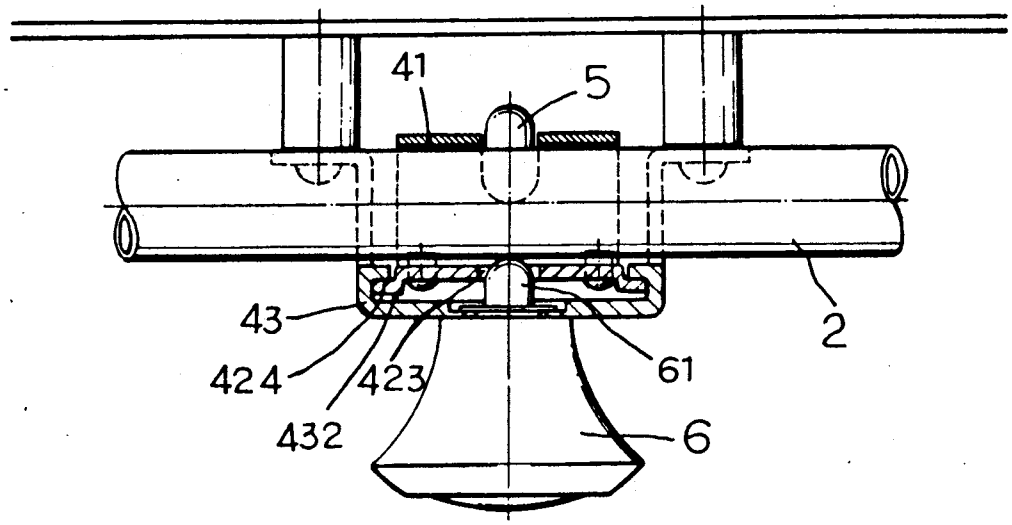
FIG. 3 is a front elevational and partial cross-section of the height adjustment device in an assembled state.

The adjustment control device 4, as shown in FIGS. 2 & 3, has a base plate 43 having a plurality of screw hole means 40 extending upwardly therefrom for attaching the base plate 43 to the bottom of the front portion 31 of the table top 3 by means of conventional screws and a pair of opposed side walls 431 partially bent into L-shaped rails 432 extending frontwardly. The base plate 43 is formed with a perforation 44 for securing a control pin device 6 under the base plate 43. The control pin device 6 includes a control pin 61 with a round head normally protruding upwardly from the perforation 44. The control pin 61 can be pulled to withdraw its round head portion from the perforation 44 by means of a control knob 60 and automatically returns to its protruding position through a spring installed therein when releasing the control knob 60.

The interconnection crossbeam 20 is secured on a slider plate 42 by means of a bracket 41. The bracket 41 is formed with a guide slot 413 and provided with two wing plates 412 extending outwardly and formed with a plurality of screw holes 411. The slider plate 42 is slidably mounted on the pair of rails 432 which engage lateral wing plates 424 of the slider plate 42. The slider plate 42 is provided with a lip 422 extending frontwardly upwardly at its front end and formed a series of pin holes 423 in a portion aligned along the longitudinal direction of the slider plate 42. The slider plate 42 is further formed with a plurality of screw holes 421 corresponding to the screw holes of the bracket 42 for securing the interconnection crossbeam 20 by means of fasteners 420.

The interconnection crossbeam 20 is drilled vertically transversely with a hole 21 for inserting therethrough with a guide pin 5 which is long enough to protrude upwardly from the hole 21 and into the guide slot 413 of the bracket 41 when assembled.

Figure 4:
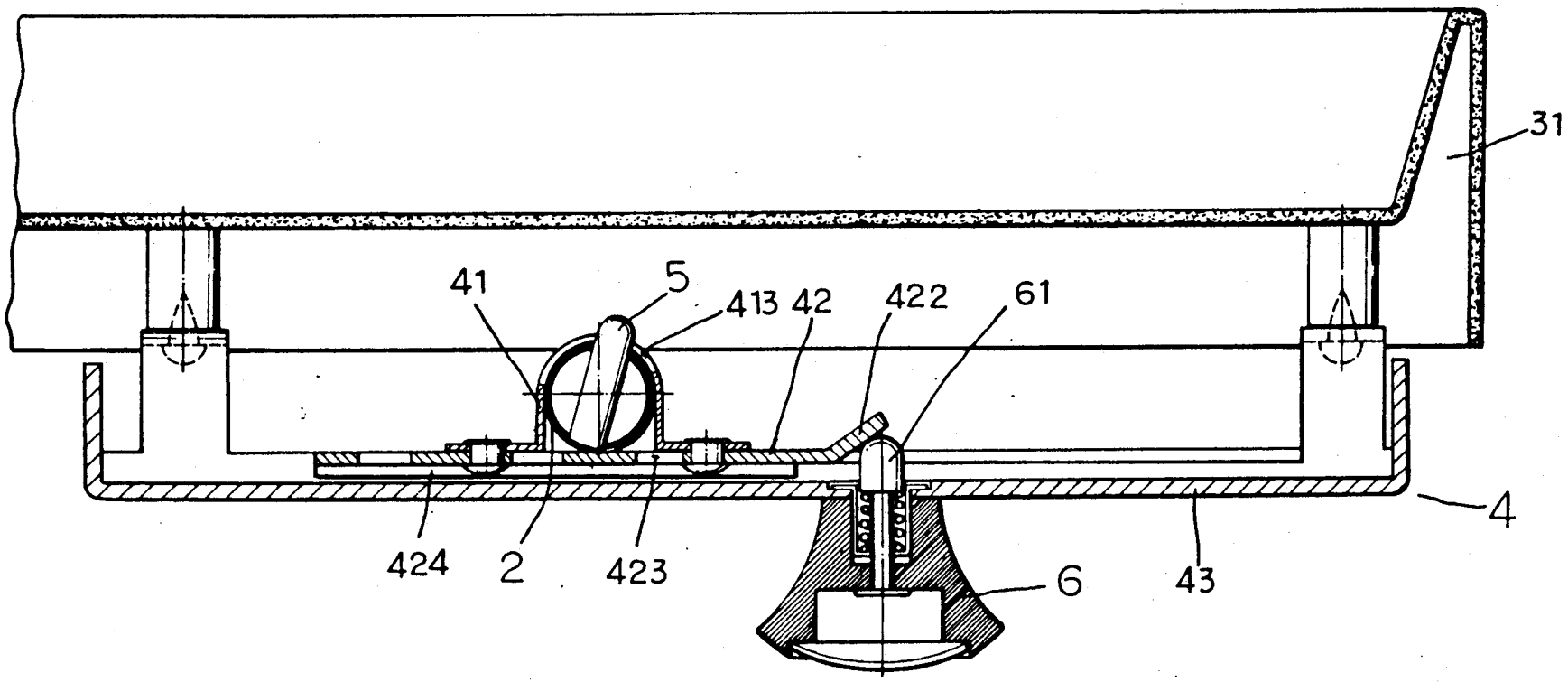
FIG. 4 is a cross-sectional view of the height adjustment device.
Figure 5:
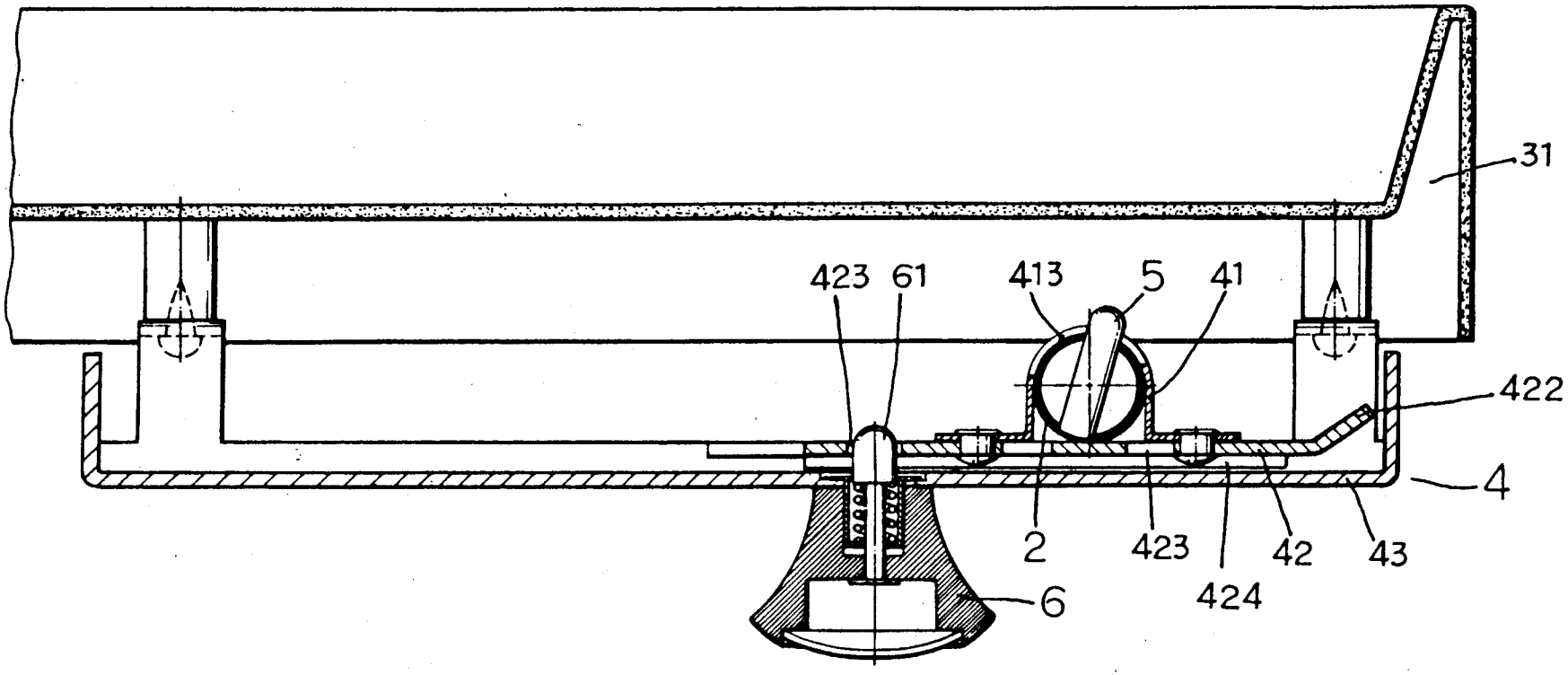
FIG. 5 is a cross-sectional view of the height adjustment device showing the operation therewith.

In operation, as shown in FIGS. 3, 4 & 5, as the slider plate 42 is adapted to move back and forth along the rails 432, the round head of the control pin 61 can be pressed to withdraw by the lip 422 of the slider plate 42 and may automatically return to engage the leading pin hole 423 of the pin holes 423 in row for locking the slider plate 42 in a position.

For further height adjustment, the round head of the control pin 61 can be withdrawn from the leading pin hole 423 by pulling downwardly the control knob 60 to release the slider plate 42 and selectively engage one of the serial pin holes 423 for placing the table top 3 in a proper height.

While there has been shown and described a preferred embodiment of the height adjustment apparatus for infant support of the invention, it is to be understood that changes in the size, structure and arrangement of structure may be made by those skilled in the art without departing from the invention.

What is claimed is:

1. A height adjustment for infant walk support comprising:

a base mounted on casters;

a table top having an opening surrounded with a perimeter;

a pair of spaced apart crossed bars interconnected by crossbeams;

said crossbars are pivoted at the middle;

said crossbars having one pair of respective ends articulated to respective ends of said base and said table top, and a second pair of respective ends connected pivotally to said table top and said base through slider members including bracket members connected to said base and an adjustment control device connected to said table top;

a base plate having a plurality of fastener members extending upwardly for attaching said base plate to a bottom section of a corresponding end of the perimeter of said table top, said base plate having a perforation formed therethrough and including a pair of side rails;

a control pin device secured under said base plate and having a pin with a head portion protruding upwardly through said perforation and adapted to be withdrawn therefrom;

slider means for slidable displacement on said rails of said base plate and formed with a plurality of pin holes aligned in a direction parallel to said rails and selectively corresponding to said perforation of said base plate for receiving said head portion of said pin, whereby said slider means is displaced along said rails to securely and reliably lock in position according to an infant's height; and means for securing a crossbeam on said slider means.

2. A height adjustment apparatus for infant walk support as claimed in claim 1 wherein the head portion of the pin has a round top.

3. A height adjustment apparatus for an infant walk support as claimed in claim 1 wherein said slider means is further provided with a lip extending frontwardly and upwardly at a leading end thereof, whereby said lip presses against said pin to force said pin from said slider plate.

* * * * *